US011100794B2

(12) United States Patent
Xu et al.

(10) Patent No.: US 11,100,794 B2
(45) Date of Patent: Aug. 24, 2021

(54) AUTONOMOUS DRIVING AND SLOWDOWN PATTERNS

(71) Applicant: HERE Global B.V., Eindhoven (NL)

(72) Inventors: Jingwei Xu, Buffalo Grove, IL (US); Yuxin Guan, Chicago, IL (US); Zongyi Xuan, Eindhoven (NL)

(73) Assignee: HERE Global B.V., Eindhoven (NL)

( * ) Notice: Subject to any disclaimer, the term of this patent is extended or adjusted under 35 U.S.C. 154(b) by 218 days.

(21) Appl. No.: 16/384,056

(22) Filed: Apr. 15, 2019

(65) Prior Publication Data

US 2020/0327804 A1 Oct. 15, 2020

(51) Int. Cl.
*G08G 1/01* (2006.01)

(52) U.S. Cl.
CPC ..... *G08G 1/0145* (2013.01); *G08G 1/0116* (2013.01); *G08G 1/0129* (2013.01); *G08G 1/0141* (2013.01)

(58) Field of Classification Search
CPC .. G08G 1/0112; G08G 1/0116; G08G 1/0129; G08G 1/0141; G08G 1/0145; G08G 1/095; G08G 1/096725; G08G 1/096775; G08G 1/096811; G08G 1/207
USPC ..... 701/117
See application file for complete search history.

(56) References Cited

U.S. PATENT DOCUMENTS 9,587,952 B1 3/2017 Slusar
9,865,019 B2 * 1/2018 Bogovich ..... H04W 4/029
9,983,013 B1 * 5/2018 Krunic ..... G01C 21/3697
10,019,901 B1 7/2018 Fields
10,395,526 B1 * 8/2019 Slusar ..... G01C 21/3453
10,540,892 B1 * 1/2020 Fields ..... G08G 1/0112
2014/0350970 A1 11/2014 Schumann, Jr.
2016/0275730 A1 9/2016 Bonhomme
2017/0134565 A1 5/2017 Crowe
2017/0241791 A1 * 8/2017 Madigan ..... G06Q 40/08
2018/0059669 A1 * 3/2018 Madigan ..... G08G 1/04
2018/0107216 A1 * 4/2018 Beaurepaire ..... B60W 50/08
2018/0127001 A1 * 5/2018 Ricci ..... B60W 40/09
(Continued)

FOREIGN PATENT DOCUMENTS

JP 2003252188 A 9/2003
JP 2006123587 A 5/2006
(Continued)

OTHER PUBLICATIONS

Extended European Search Report issued in related Application No. 20169643.2 dated Oct. 14, 2020 (7 pages).
(Continued)

*Primary Examiner* — Atul Trivedi
(74) *Attorney, Agent, or Firm* — Lempia Summerfield Katz LLC

(57) ABSTRACT

A method and apparatus for providing safety related messages to one or more vehicles is based on slowdown data collected in association with one or more vehicles. Historical slowdown data for a set of road segments is identified. One or more corresponding road geometries are accessed for the set of road segments. A comparison is performed for the one or more road geometries and a predetermined set of templates. Based on the comparison, a matching template is identified. A score is calculated for the road segment based on the matching template and the historical slowdown data.

20 Claims, 11 Drawing Sheets

(56) References Cited

U.S. PATENT DOCUMENTS

| | | | | |
|---|---|---|---|---|
| 2019/0051153 | A1* | 2/2019 | Giurgiu | G01C 21/3811 |
| 2019/0051172 | A1* | 2/2019 | Stenneth | H04W 4/44 |
| 2019/0080266 | A1* | 3/2019 | Zhu | G01C 21/3453 |
| 2019/0101924 | A1* | 4/2019 | Styler | B60W 30/0956 |
| 2019/0102840 | A1* | 4/2019 | Perl | B60W 40/09 |
| 2019/0213873 | A1* | 7/2019 | Adireddy | G08G 1/164 |
| 2019/0250626 | A1* | 8/2019 | Ghafarianzadeh | G08G 1/165 |
| 2019/0311614 | A1* | 10/2019 | Yang | G05D 1/0246 |
| 2019/0347821 | A1* | 11/2019 | Stein | G05D 1/0274 |
| 2020/0090504 | A1* | 3/2020 | Kadar | G08G 1/0112 |
| 2020/0111349 | A1* | 4/2020 | Mubarek | G08G 1/0141 |
| 2020/0135022 | A1* | 4/2020 | Xu | G08G 1/0112 |
| 2020/0166897 | A1* | 5/2020 | Campos | B60R 11/04 |
| 2020/0238999 | A1* | 7/2020 | Batts | G08G 1/165 |
| 2020/0242922 | A1* | 7/2020 | Dulberg | G08G 1/096783 |
| 2020/0272832 | A1* | 8/2020 | Urano | G06K 9/00805 |
| 2020/0324761 | A1* | 10/2020 | Magzimof | G05D 1/0011 |
| 2020/0327804 | A1* | 10/2020 | Xu | G08G 1/096811 |
| 2020/0365014 | A1* | 11/2020 | Ray | G06K 9/00302 |
| 2021/0004615 | A1* | 1/2021 | Yashiro | G06K 9/00791 |

FOREIGN PATENT DOCUMENTS

| | | | | |
|---|---|---|---|---|
| JP | 2006137259 | A | 6/2006 | |
| WO | WO2016025103 | A1 | 2/2016 | |
| WO | WO-2019195415 | A1 * | 10/2019 | G08G 1/096725 |

OTHER PUBLICATIONS

Hourdos, John, Vishnu Garg, and Panos Michalopoulos. "Accident Prevention Based on Automatic Detection of Accident Prone Traffic Conditions: Phase I." Sep. 2008. (pp. 1-169).

* cited by examiner

AUTONOMOUS DRIVING AND SLOWDOWN PATTERNS

FIELD

The following disclosure relates to the detection of slowdown events on a roadway and messages generated in response to the slowdown events.

BACKGROUND

There are various technologies currently available to provide traffic information. For example, the Traffic Message Channel (TMC) is a technology for broadcasting traffic and travel information to motor vehicle drivers. It is digitally coded, using the Radio Data System (RDS) on conventional FM radio broadcasts. It can also be transmitted on Digital Audio Broadcasting (DAB) or satellite radio. The broadcast RDS-TMC code may be used globally and meet various broadcast uniqueness requirements regionally. The combination of Country Code, Table Number, and TMC Location Code is unique globally. An example of another technology is one known as the Transport Protocol Experts Group (TPEG) that was designed for the transmission of language independent multi-modal traffic and travel information.

While existing traffic information systems provide broad indicates of traffic levels along roadways over time, challenges remain in developing an efficient and immediate technique for detecting dangerous slowdown events at specific locations on roadways.

SUMMARY

In one embodiment, a method for providing safety messages for vehicles including receiving location data for at least a first vehicle of a plurality of vehicles, map matching the location data for at least the first vehicle to a road segment, identifying a road geometry for the matched road segment, performing a comparison of the road geometry to a predetermined set of templates, identifying a matching template in response to the comparison, receiving slowdown data for the road segment, and calculating a score for the road segment based on the matching template and the slowdown data.

In one embodiment, an apparatus for providing safety messages for vehicles includes a location module, a map matching module, a road geometry module, and a slowdown module. The location module is configured to access location data for at least a first vehicle of a plurality of vehicles. The map matching module is configured to match the location data for at least the first vehicle to a road segment. The road geometry module is configured to perform a comparison of a road geometry for the matched road segment to a predetermined set of templates and identify a matching template in response to the comparison. The slowdown module configured to receive slowdown data for the road segment and calculate a score for the road segment based on the matching template and the slowdown data.

In one embodiment, a non-transitory computer readable medium including instructions that when executed by a process are configured to perform receiving historical slowdown data for a set of road segments, accessing at least one road geometry for the set of road segments, performing a comparison of the at least one road geometry to a predetermined set of templates, identifying a matching template in response to the comparison, calculating a score for the road segment based on the matching template and the historical slowdown data.

BRIEF DESCRIPTION OF THE DRAWINGS

Exemplary embodiments of the present invention are described herein with reference to the following drawings.

DETAILED DESCRIPTION

Figure 1:
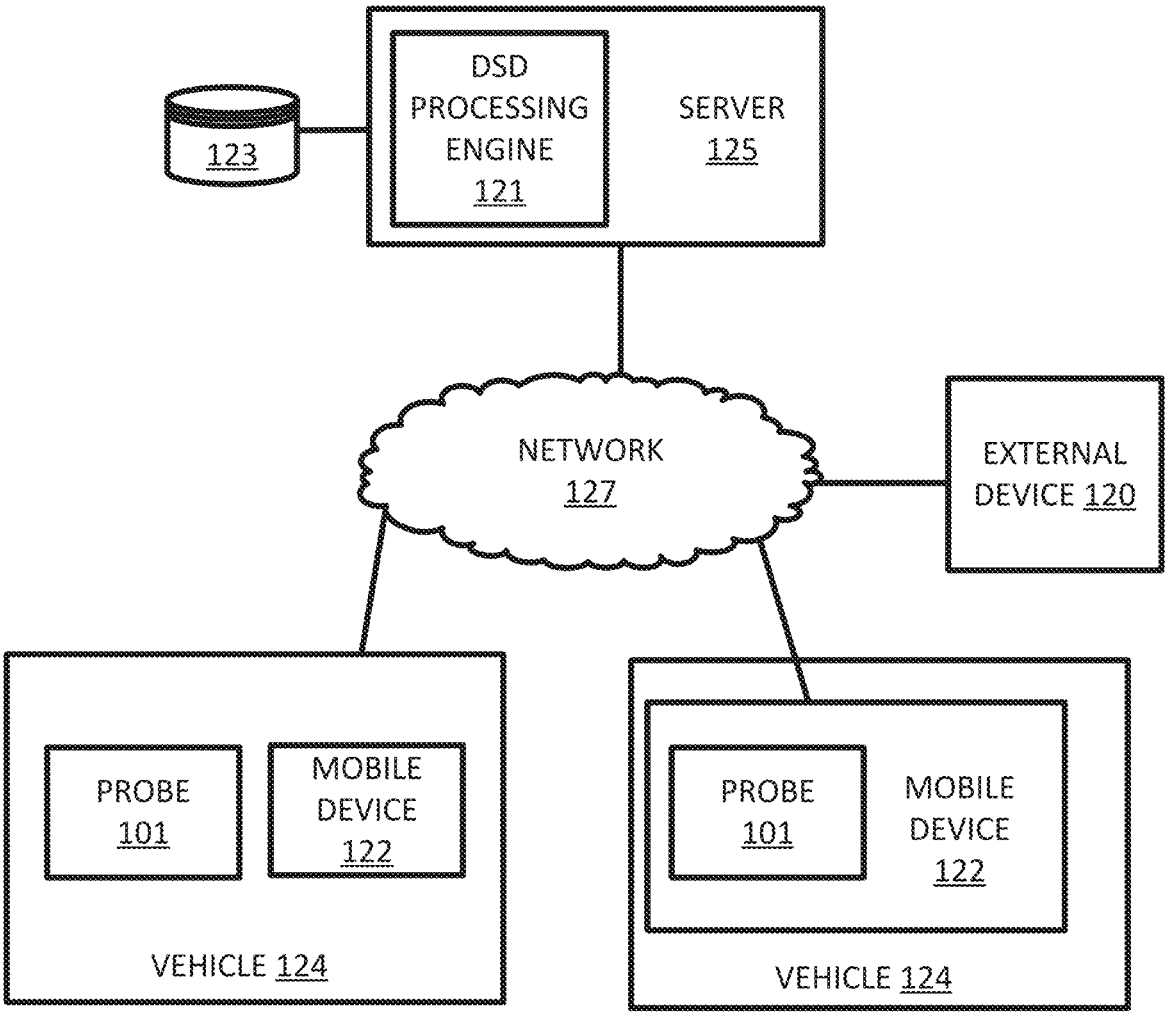
FIG. 1 illustrates an example system for detection and analysis of slowdown events.

With respect to driving systems, the term autonomous may refer to a vehicle configured for driving on the road without human intervention, or with reduced human intervention or involvement. An autonomous vehicle uses various sensors technologies and high definition (HD) maps or dynamic backend content including traffic information services to aid the vehicle's engine control module (ECM) system for the right decision strategy for how to drive along the road network.

Autonomous driving systems may operate in different modes of operation from assisted to fully anonymous. The Society of Automotive Engineers has defined autonomy level definitions, including six levels for driving automation. Level 0 includes automated system issues warnings and may momentarily intervene but has no sustained vehicle control. In Level 1, or hands mode, the driver and the automated system share control of the vehicle. Examples are Adaptive Cruise Control (ACC), where the driver controls steering and the automated system controls speed; and Parking Assistance, where steering is automated while speed is manual. The driver must be ready to retake full control at any time. Lane Keeping Assistance (LKA) Type II is a further example of level 1 self-driving.

In Level 2, or hand off mode, the automated system takes full control of the vehicle (accelerating, braking, and steering). The driver must monitor the driving and be prepared to intervene immediately at any time if the automated system fails to respond properly. In Level 3, or eyes off mode, the driver can safely turn their attention away from the driving tasks, e.g. the driver can text or watch a movie. The vehicle will handle situations that call for an immediate response, like emergency braking. The driver is still prepared to intervene within some limited time, specified by the manufacturer, when called upon by the vehicle to do so. When activated by the human driver, the car takes full control of all aspects of driving in slow-moving traffic at up to 60 kilometers per hour. The function works only on highways with a physical barrier separating one stream of traffic from oncoming traffic.

In Level 4, or mind off mode, includes the functionality of Level 3, but no driver attention is required for safety, i.e. the driver may safely go to sleep or leave the driver's seat. Self-driving is supported only in limited spatial areas (geofenced) or under special circumstances, such as traffic jams. Outside of these areas or circumstances, the vehicle must be able to safely abort the trip, i.e. park the car, if the driver does not retake control. In Level 5, or steering wheel optional mode, no human intervention is required. An example is a robotic taxi. As described above, Level 4 vehicle would be driverless in most scenarios and Level 5 vehicle is fully non-human involved vehicles. For safety reasons, the ability to identify the reason for an autonomous vehicle status change update can be beneficial for the vehicle driver or customer or agencies to better understand the current environment and how best to react to improve safety and mobility.

The following embodiments include systems for detecting and reporting the road segment traffic flow information and incident information as the services to be used for highly automated driving, for example on Level 3 or Level 4, and even further for Level 5 level autonomous driving for multiple purposes such as road safety enhancement and routing navigation improvement.

The following embodiments include slowdown event detection methods and processing systems. The slowdown event may be an occurrence of abrupt slowdown of vehicles along a roadway. The slowdown event may occur when traffic slows or stops in response to a traffic incident. The traffic incident may be a collision, an accident, or a traffic jam. The slowdown event may be in response to a weather condition (e.g., white out, snow, ice, rain). The slowdown event may be a dangerous slowdown event as determined by the rate of decrease in speed of one or more vehicle on the roadway.

The slowdown event may be a result of traffic congestion queue or jam that may occur and start accumulating as a result of traffic volume exceeding the available road capacity. This may be caused by multiple reasons: weather such as heavy snow or fog, sport events, or other temporal events. Dangerous queuing situations may result in significant crashes or bottlenecks. These bottlenecks sometimes lead to secondary crashes, and on occasion lead to catastrophic events such as multiple vehicle pile-ups.

The following embodiments analyze road geometry for the sections of road corresponding to the slowdown event. Certain shapes of the road geometry or certain intersections are identified that may be disruptive to traffic. Example disruptive road geometry may include merging, sharp turns and curves, or complex intersections. In response to a combination of the slowdown event and the road geometry, flow or incident messages are provided. For example, a traffic processing engine may provide the messages to a road infrastructure system (e.g., an instruction displayed on a roadway for speed limit or warning message), an emergency vehicle that is dispatched, or a moving road block. In another example, the messages are delivered to end customers (e.g., client devices) in various ways including by over the air radio interfaces or by connected internet. The messages may be delivered to autonomous vehicle to identify problem locations along the roadway and take measures to avoid and/or safely navigate the problem locations.

The system for detection of slowdown events is in the technological field of automotive safety. Safety is improved when alerts sent to drivers prevent accidents for vehicles approaching the slowdown events. This can also support a governmental agency to identify these problem locations more quickly to help in better positioning service patrol resources (i.e., highway helper trucks). With such services, for example, the agency has the ability to alert all mobile phone users in a targeted area (through geofencing) using the state's emergency messaging system.

The system for detection of slowdown events is in the technological field of assisted or autonomous driving. Driving commands provided to the assisted or autonomous driving improve the driving experience because abrupt stops are prevented. Similarly, in assisted or autonomous driving systems, the driving commands in response to the slowdown prevents accidents. In addition, the system for detection of slowdown events may bring other benefits like a decrease in fuel consumption and an improvement in traffic flow. The system for detection of slowdown events is in the technological field of navigation. Improvements to navigation include more efficient routes that avoid slowdown events.

FIG. 1 illustrates an example system for detection and analysis of slowdown events. In FIG. 1, one or more vehicles 124 are connected to the server 125 though the network 127. The vehicles 124 may be directly connected to the server 125 or through an associated mobile device 122. A specialized traffic processing engine, or dangerous slowdown (DSD) processing engine 121, including the server 125 and a geographic database 123, exchanges (e.g., receives and sends) data from the vehicles 124. The server 125 may process information data from the vehicles 124 and send instructions or messages to the vehicles 124, mobile devices 122, or an external device 120. The mobile devices 122 may include local databases corresponding to a local map, which may be modified according to the server 125. The local map may include a subset of the geographic database 123 and are updated or changed as the vehicles 124 travel. The mobile devices 122 may be standalone devices such as smartphones or devices integrated with vehicles. Additional, different, or fewer components may be included.

Each vehicle 124 and/or mobile device 122 may include position circuitry such as one or more processors or circuits for receiving signals from a global navigation satellite system (GNSS) signals and comparing the GNSS signals to a clock to determine the absolute or relative position of the vehicle 124 and/or mobile device 122. The mobile device 122 may act as probe 101 for determining the position or the mobile device 122 and the probe 101 may be separate devices. The absolute or relative position may be stored as location data. The location data may include geographic coordinates (e.g., longitude and latitude). The location data may include a heading and/or a speed. Alternatively, heading and/or speed may be calculated from a series of points of location data.

The DSD processing engine 121 may receive one or more data inputs from a subset of the vehicles 124 and provide one or more message to other vehicles 124 or to an external device 120. The inputs to the DSD processing engine 121 may include location data such as real time probe data including sensor data received from mobile devices 122 or probe vehicles 124, and map artifact data which describes the road segment topology and geometry. Upon receiving real time probe data, the DSD processing engine 121 processes the probe data and performs one or more processing steps such as map matching or pathing. The DSD processing engine 121 is configured to output an estimate of the current travel speed for a given road segment. As described herein road links or paths defined according to sections delineated by TMC identifiers or the TMC system may be substituted for road segments. Based on the output speed category, the road condition can be further described as free flow, queueing, or stationary. Free flow may be a speed uninhibited by traffic. Queueing may be a speed impacted by vehicles slowed by their proximity to one another. Stationary may be slowed or stopped. Driving speed equal to or lower than queueing speed would be considered as road congestion.

The DSD processing engine 121 is configured to analyze the location data to identify slowdown events. The DSD processing engine 121 may identify a series of location data (e.g., samples of location data taken at time intervals) for a particular probe 101, mobile device 122, or vehicle 124. The DSD processing engine 121 may determine points in the series of location data that correspond to a predetermined section of roadway. The section of roadway may be a road segment or a portion of the road associated with a traffic message code. Alternatively, the DSD processing engine 121 may analyze the entire series of location data.

The DSD processing engine 121 may determine a first speed from the series of location data. The first speed (or initial speed) may be calculated from the two or more points (e.g., the first two points) of the series of location data. The first speed may alternatively be extracted from the first point in the series of location data (e.g., when the location data includes a speed value).

The DSD processing engine 121 may determine a second speed from the series of location data. The second speed (or final speed) may be calculated from two or more points (e.g., the last two points or more recent two points) of the series of location data. The second speed may alternatively be extracted from the last point in the series of location data (e.g., when the location data includes a speed value).

The DSD processing engine 121 may compare the first speed and the second speed to determine how quickly the corresponding vehicle 124 has slowed down. The DSD processing engine 121 may compare a difference between the second speed and the first speed to a slowdown threshold. The slowdown threshold may depend on a time interval between the measurements of the first speed and the second speed. The time interval may be calculated from subtract a timestamp associated with the first speed from a timestamp associated with the second speed. Examples for the slowdown threshold may be 10 miles per hour per second, 20 miles per hour second, or another threshold.

When the slowdown threshold is exceeded, the vehicle 124 has slowed down at a rate that indicates a slowdown event or a dangerous slowdown event may logged in historical data. The DSD processing engine 121 may compile a historical data log from vehicle 124 over time or from multiple vehicles 124 over time. The historical data log may be stored in geographic database 123.

The DSD processing engine 121 may store the slowdown event in associated with a time span restriction. For example, the time span restriction may correspond to road construction. Different time span restrictions may be tied to different functional classification of roadway. For example, highways or arterial roads may experience slowdown events that are highly correlated with road construction.

The DSD processing engine 121 may access a road geometry from the geographic database 123 in response to the location data. The road geometry may be compared to one or more templates to identify a predetermined shape associated with slowdown events. In response to the comparison, the DSD processing engine 121 may generate a geometry slowdown message or a geometry slowdown factor.

The DSD processing engine 121 may calculate a safety factor score based on at least the speed slowdown message or the speed slowdown factor and the geometry slowdown message or the geometry slowdown factor. The DSD processing engine 121 may provide the safety factor score directly to one or more vehicles 124 or to the external device 120 or through the network 127.

When the vehicles 124 are autonomous or assisted vehicles messages may be sent from the server 125 to the vehicles 124. The messages may aid in the direct control of the vehicle or in the assistance to the driver. The messages may include a navigation command that provides a route to the vehicle 124 or driver. The messages may include a driving command that controls a particular operation of the vehicle 124. The messages may include data, such as slowdown messages, from which the control system of the vehicle 124 generates the navigation command or the driving command.

When the external device 120 is a traffic message center, the slowdown message may instruct the external device 120 to broadcast a warning to one or more other mobile device 122 or vehicles 124. When the external device 120 is a traffic message center, the slowdown message may instruct a sign to display an alert to other vehicles. Example alerts may include dangerous slowdown ahead, caution, or other warnings. The slowdown message may include a geographic location, a segment identifier, or a link PVID (published version identifier).

When the external device 120 is a transportation administrator (e.g., department of transportation device), the message may instruct a traffic diversion device. The traffic diversion device may include a vehicle that is dispatched ahead (e.g., upstream) of the slowdown event. The vehicle may warn subsequent vehicles or divert subsequent vehicles. The traffic diversion device may include signage that diverts or detours subsequent traffic.

Communication between the vehicles 124 and/or between the mobile device 122 and the server 125 through the network 127 may use a variety of types of wireless networks. Example wireless networks include cellular networks, the family of protocols known as WiFi or IEEE 802.11, the family of protocols known as Bluetooth, or another protocol. The cellular technologies may be analog advanced mobile phone system (AMPS), the global system for mobile communication (GSM), third generation partnership project (3GPP), code division multiple access (CDMA), personal handy-phone system (PHS), and 4G or long term evolution (LTE) standards, 5G, DSRC (dedicated short range communication), or another protocol. Communication between the vehicles 124 and/or between the mobile device 122 and the server 125 through the network 127 may use data messages over the air radio interface, TPEG service by connected HTTP or UDP protocol, and/or DSRC broadcasting data.

Figure 2:
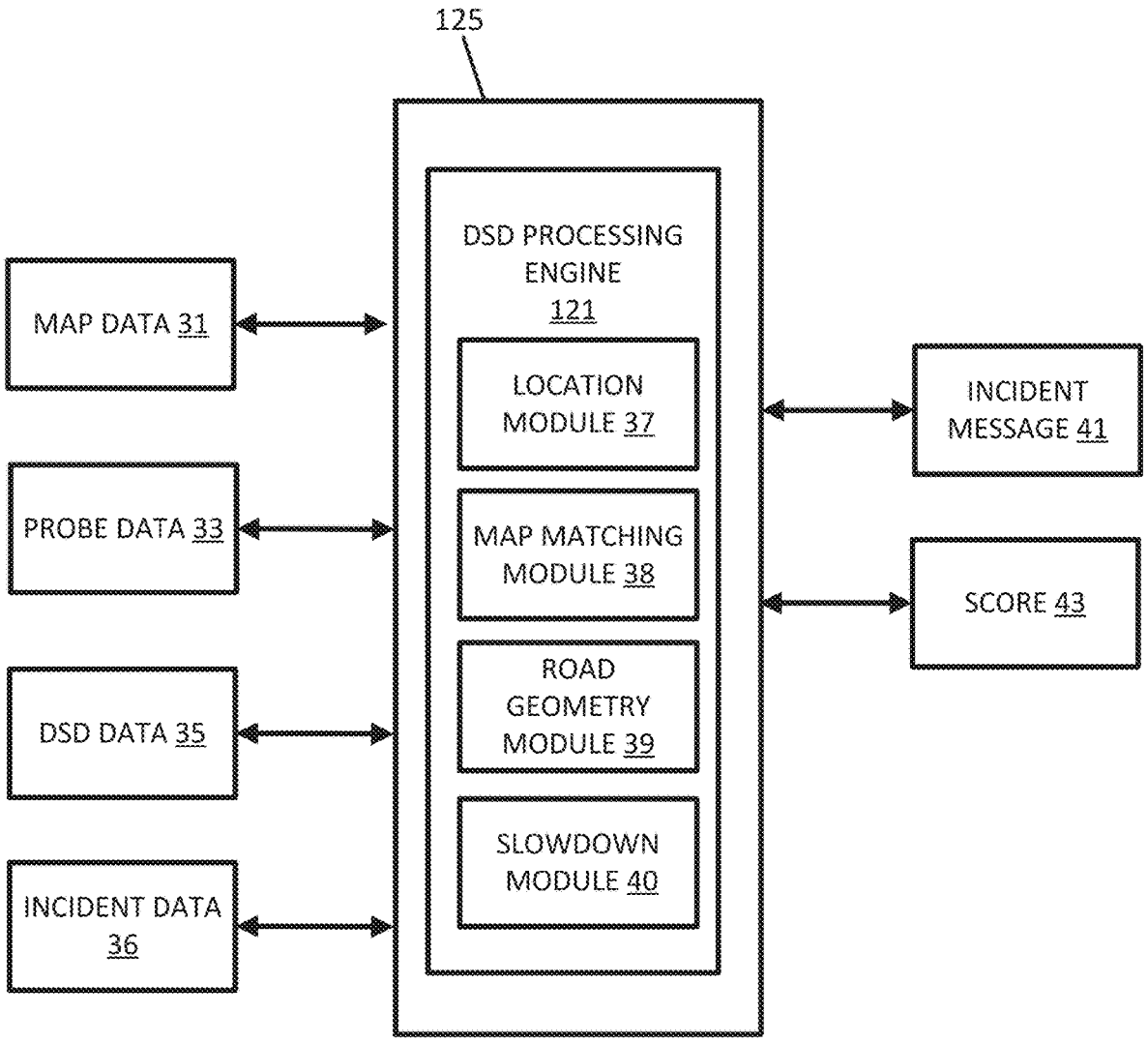
FIG. 2 illustrates an example dangerous slowdown event engine from the system of FIG. 1.

FIG. 2 illustrates an example DSD processing engine 121 from the systems of FIG. 1. The DSD processing engine 121 may include a location module 37, a map matching module 38, a road geometry module 39, and a slowdown module 40. The DSD processing engine 121 may include multiple inputs including map data 31, probe data 33, DSD data 35, and the incident data 36. The DSD processing engine 121 generates the incident message 41. Additional, different, or fewer components may be included.

The location module 37 is configured to access location data for one or more vehicles, including a first vehicle. The location module 37 may interface with mobile device 122 or vehicle 124 to receive location data from the probe data 33 collected by a sensor such as the position circuitry. The probe data 33 may be received from one or more sources. In some examples, the probe data 33 is collected by a mobile device such as smartphone or portable computer running a mapping or navigation application that collects samples of locations data as latitude and longitude pairs over time. The probe data 33 may be collected by vehicles 124 by a similar navigation system. The probe data 33 may be received from a third party such as a service provider or government entity. The probe data 33 may be detected from sensors such as a camera (e.g., image processing on camera images to identify the locations of the vehicles) or a distance data detection system (e.g., light detection and ranging point cloud with the location of vehicles).

The location module 37 may sort and/or filter the location data according to one or more parameters. Examples of the parameter may include the sender of the location data, the geographic location of the location data, or the time of the location data. The location module 37 may filter the location data according to a device identifier (e.g., for the mobile device 122 or the vehicle 124). In this way, the location module 37 identifies individual trips or traces of data. The location module 37 may filter the location data according to geographic data to group the location data for a road of interest or geographic region collected from multiple devices. In this way, the location data for a road is crowd-sourced from multiple vehicles. The location module 37 may filter the location data according to times (e.g., timestamp) associated with the location data. In this way, the location data is grouped according to time epochs for particular times of day, days of week, or category of day (e.g., weekday, weekend day, or holiday).

In one example, in response to the probe data 33 or location data being received at the DSD processing engine 121, the occurrences of DSD events are determined and stored in DSD data 35 generated at the DSD processing engine 121. In other examples, the DSD data 35 is externally generated and received at the DSD processing engine 121.

The DSD processing engine 121 analyzes the probe data at the location module 37 to determine paths for multiple vehicles. The DSD processing engine 121 calculates an approaching speed for vehicles 124. In some examples, the speed is extracted from the probe data 33 for the initial vehicle 124. The approaching speed may be a free flow speed of the road segment. The DSD processing engine 121 is configured to compare the approaching speed to an initial speed threshold. Speeds over the initial speed threshold indicate that the vehicle is moving normally along the road segment. The initial speed threshold may be the free flow speed of the road segment or a predetermined percentage (e.g., 80% or 50%) of the free flow speed of the road segment. The DSD processing engine 121 calculates a final speed for the vehicle 124 at a second time. In some examples, the speed is extracted from the probe data 33 for the initial vehicle 124. The final speed may be determined at any time that the initial vehicle 124 experiences a significant slowdown. For example, a speed module may monitor that speed of the initial vehicle 124 and measure the final speed when a recent slowdown has occurred. The slowdown may be determined by an absolute or percentage drop in speed, which is a maximum speed threshold. The speed module is configured to compare a difference in the final speed and the initial speed to maximum speed threshold.

In one alternative, the speed module may be configured to compare the final speed to a final speed threshold, and the traffic slowdown message is generated in response to the final speed being less than the final speed threshold.

The speeds may be calculated for a predetermined length of road such as a road segment, a portion of a road segment, or a geometry associated with a traffic message code. In other examples, the initial speed and the final speed are updated continuously by a configurable sliding window having a duration (less than a predefined time period for example 20 minutes).

The DSD processing engine 121 may include a timing module calculates a difference between a first time for the initial speed and a second time for the final speed. The timing module is configured to compare the difference between the first time and the second time to a time interval threshold. The time interval threshold may be set according to a user input for the granularity of the slowdown detection. Larger duration for the time interval may improve detection quantity of slowdown events but may slow the response time in returning results from the detection.

The DSD processing engine 121 may determine that a slowdown event has occurred with a speed of a vehicle has meet a minimum speed (e.g., initial speed threshold) and subsequently has been reduced by a certain percentage of speed (e.g., defined by the maximum speed threshold)/absolute difference with a predetermined time frame (e.g., the time interval threshold).

In addition or in the alternative, the DSD processing engine 121 may receive the DSD data 35 or the incident data 36, which is also indicative of a slowdown event. The incident data 36 may describe an incident, such as an accident or other traffic event. The DSD data 35 describes locations for slowdown event that have been detected externally to the DSD processing engine 121. The DSD processing engine 121 may combine the received DSD data 35 or incident data 36 with the probe data 33 when identifying the slowdown event.

The map matching module 38 is configured to match the location data for at least the first vehicle to a road segment. The map matching module 38 may project the location data from the GNSS onto a road network, which may be accessed from the geographic database 123. One or multiple matching techniques may be used such as geometric, graph centric, probabilistic or any combination of these. Geometric techniques use spatial properties like geometric distance, curvature, or other properties to find the closest link or road segment. Graph based methods use road connectivity information other than position information to match successive points to a path. The map matching technique may use the proximity of the positioning point to a segment, the heading, the similarity between the heading of successive points and a segment and, and a relationship between segments and positioning points. For example, a path based map matcher may give more weight to a segment when calculating a segment map if the link connects to a previous link the in the path of the device. The map matched positional points and the links may be presumed to be accurate or equivalent to ground truth data. Ground truth refers to information provided by direct observation as opposed to information provided by inference.

Probabilistic filtering techniques model the underlying uncertainty of the observed signal and jointly find the most likely state sequences (e.g., links or segments) that generated the observation. Other techniques may be based on supervised learning, fuzzy logic, or other examples. The map matching techniques may be either greedy or jointly optimal, depending on the optimality of the solution. The greedy approach finds the closest link segments for each point, which could be sub optimal, considering the noise in the data source. More optimal techniques jointly assign the entire sequence so that matching is globally optimal. The jointly optimal techniques take advantage of the sub-sequence optimality to build optimal sequences using dynamic programming.

The road geometry module 39 is configured to perform a comparison of a road geometry for the matched road segment to a predetermined set of templates and identify a matching template in response to the comparison.

The road geometry module 39 determines the map of the match road segment. The road geometry module 39 may analyze the probe data for the road segment. The road geometry module 39 may lookup the shape of the road segment from the road network in the geographic database 123. For example, the geographic database 123 may include road attributes for road segments. Example road attributes may include decimal values, scaled values, or fractional values for quantities such as curvature, slope, or bank. That is, one road segment may have a curvature of 5 and another road segment have a curvature of 8. The road attributes may include flags or binary values for one or more features that are either on or off such as whether the road segment includes a merge junction or a split. The merge junction and the split may have similar road geometries but the type of feature depends on the direction of travel. In one example, the other attributes such as curvature, slope or bank may also be indicated by a flag or binary value (e.g., either the curvature, slope, or bank is above a threshold and the flag is on or it is below the threshold and the flag is off). The road attribute may also indicate a road structure. Example road structures include bridges, tunnels, overpasses or other examples.

Figure 3:
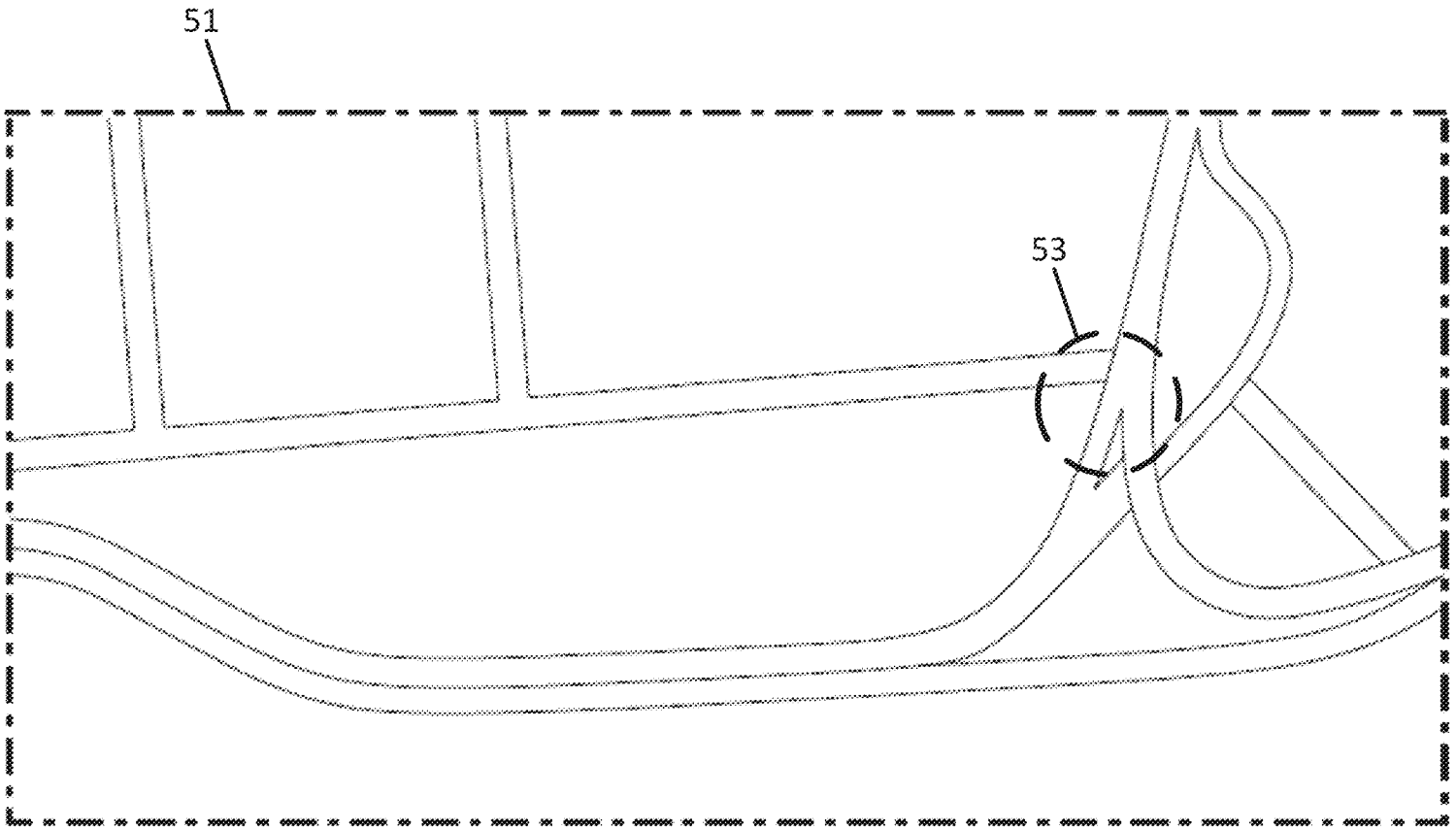
FIG. 3 illustrates an example road network.

FIG. 3 illustrates an example road network 51 for the analysis of FIG. 3. The road network 51 includes a road geometry 53 that is associated with a slowdown template. As illustrated, the road geometry 53 include a merge or split of the roadway.

The road geometry module 39 may access the set of templates from memory, geographic database 123 or from another source. The templates may include one or more predetermined turns, one or more predetermined slopes, one or more merge junctions, one or more predetermined curves or other road features.

Figure 4:
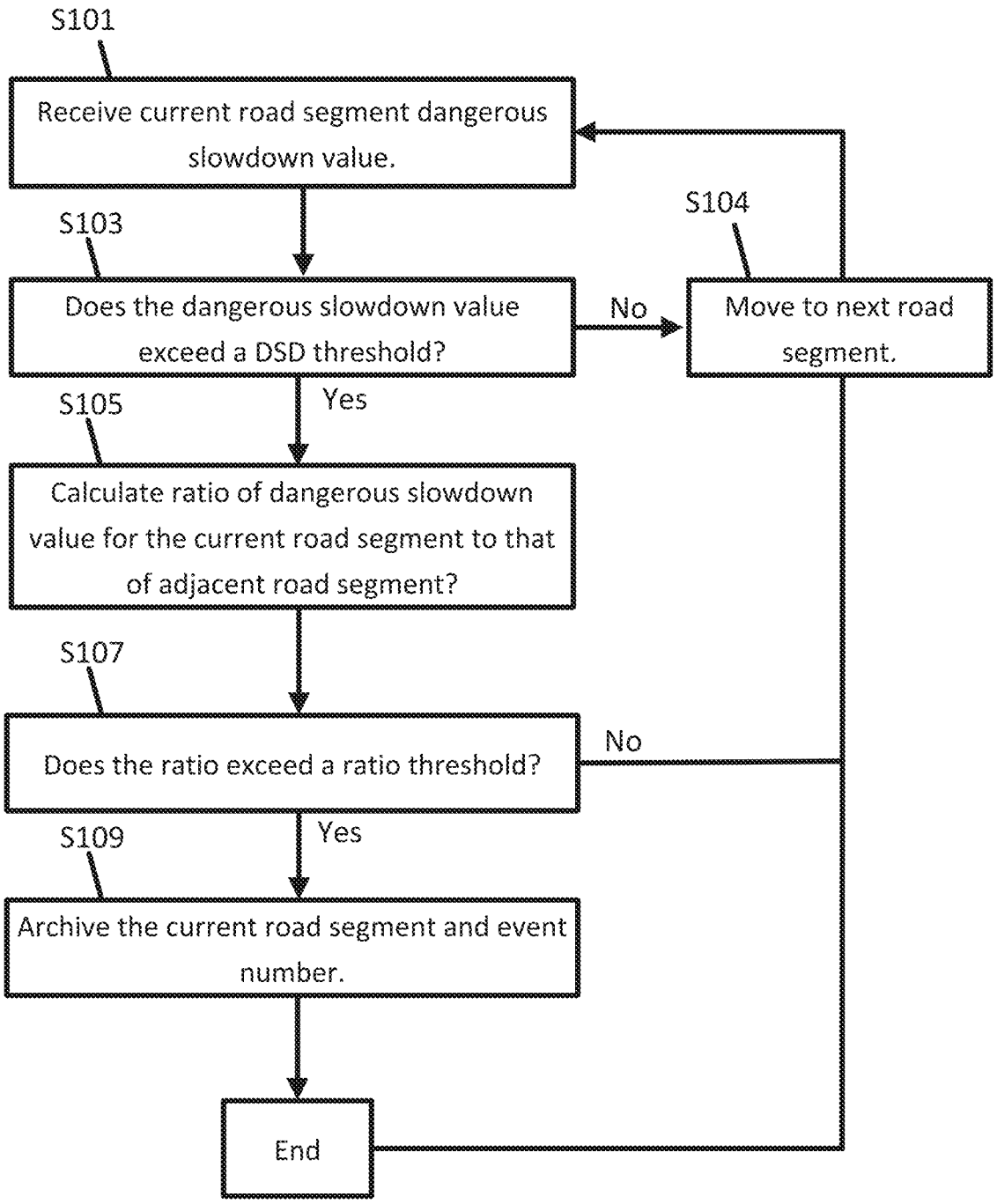
FIG. 4 illustrates an example flowchart for the analysis of dangerous slowdown events for a road network.

FIG. 4 illustrates an example flowchart for the analysis of dangerous slowdown events for a road network by the DSD processing engine 121. The road network may include road segments in a pattern that corresponds to the roadway. Road segments that are connected may be considered adjacent road segments. Adjacent road segments may share, or be coupled with, a node or intersection. Vehicles may travel from locations corresponding to one road segment directly onto its adjacent road segment. The analysis may iterate through a list of road segments to identify the road segments that correspond to dangerous slowdown event. The list of road segments may be the road segments in a particular geographic area, the road segments for a route, or all road segments provided to the DSD processing engine 121 or stored in geographic database 123. Additional, different, or fewer acts may be included.

At act S101, the DSD processing engine 121 receives the current road segment dangerous slowdown (DSD) value. The DSD value may be associated with a road segment DSD historical event number for indexing the event. The event number may be unique for geography and in time. The road segment DSD historical event number may have a time span or time to live value that is accessed by the DSD processing engine 121 to determine whether the road segment DSD historical event number has expired. The time span may be set according to a construction schedule or report of construction on a particular roadway. The time span limiter may be applied only to predetermined functional classification. Some road classifications such as local roads may unaffected by the time span limiter. Some road classifications such as arterial roads may be highly affected by the time span limiter. Other road classification such as collected roads may be moderately affected by the time span limiter. Weights or time values may be adjusted according to functional classification.

At act S103, the DSD processing engine 121 determines whether the received dangerous slowdown value exceeds a threshold. When the received dangerous slowdown value exceeds the threshold, the corresponding road segment is a candidate for a dangerous slowdown event and adjacent road segments will be analyzed. When the received dangerous slowdown value does not exceed the threshold, the process moves to the next road segment in the list or index and returns to act S101.

At act S105, the DSD processing engine 121 calculates a ratio of the dangerous slowdown value for the current road segment to that of an adjacent road segment. The DSD processing engine 121 may identify an adjacent road segment adjacent to the initial road segment and receive second slowdown data in the form of a DSD value for the adjacent road segment. The DSD value for the adjacent road segment, which may also be associated with a road segment DSD historical event number for indexing the event. The DSD processing engine 121 determines a ratio between the DSD value for the initial road segment to the DSD value for the adjacent road segment. That is, the DSD processing engine 121 may divide the initial DSD value by the adjacent DSD value. In some examples, rather than a ratio, the difference between the DSD value for the initial road segment and the DSD value for the adjacent road segment is calculated.

In some examples, the DSD processing engine 121 may calculate an upstream ratio and a downstream ratio. The upstream ratio is a ratio between the DSD value for the initial road segment to the DSD value for an upstream road segment. The upstream road segment may be the road segment immediately adjacent to and upstream of the initial road segment. When there are multiple upstream road segments, multiple upstream ratios may be calculated.

The downstream ratio is a ratio between the DSD value for the initial road segment to the DSD value for a downstream road segment. The downstream road segment may be the road segment immediately adjacent to and downstream of the initial road segment. When there are multiple downstream road segments, multiple downstream ratios may be calculated.

At act S107, the DSD processing engine 121 determines whether the ratio from act S105 exceeds a ratio threshold. When the ratio exceeds the threshold, one road segment is experiencing the slowdown event but the next road segment is not experiencing the slowdown event. When the difference between DSD values is substituted for the ratio, a difference threshold is used instead of the ratio threshold. The term adjacent threshold may refer, in the alternative, to the ratio threshold or the difference threshold for the relationship between one road segment to one or more adjacent threshold.

At act S109, the current road segment information is archived in response to the ratio exceeding the ratio threshold. In addition, the road segment DSD historical event number is archived. Archiving the road segment DSD historical event may include storing the initial road segment and/or the adjacent road segment in association with a slowdown event. The location of the slowdown event may be accessed according to any of the examples herein. When the ratio does not exceed the ratio, the process ends, or iterates to the next road segment for analysis.

The slowdown module 40 is configured to receive slowdown data for the road segment and calculate a score for the road segment based on the matching template and the slowdown data. The score may be made up of multiple components or score adjustment values. The slowdown module 40 may sum the multiple components or score adjustment values to determine the score.

The slowdown module 40 may calculate a score adjustment value for the matching template. The score adjustment value may depend on the matching technique and degree of matching. The score adjustment value may be calculated based on the matching technique such that different weights are applied to a geometric matching technique, a graph centric matching technique, or a probabilistic matching technique. The score adjustment value may be calculated based on the degree of matching. A complete matching may have a higher score adjustment value than a partial match. The score adjustment value may be calculate based on a confidence value from the matching technique.

The slowdown module 40 may calculate a score adjustment value for the comparison of the ratio of the dangerous slowdown value for the current road segment to that of an adjacent road segment to the adjacent threshold. The score adjustment value may be larger as the difference between the ratio and the threshold is larger. The score adjustment value may be proportional to the difference.

Figure 5:
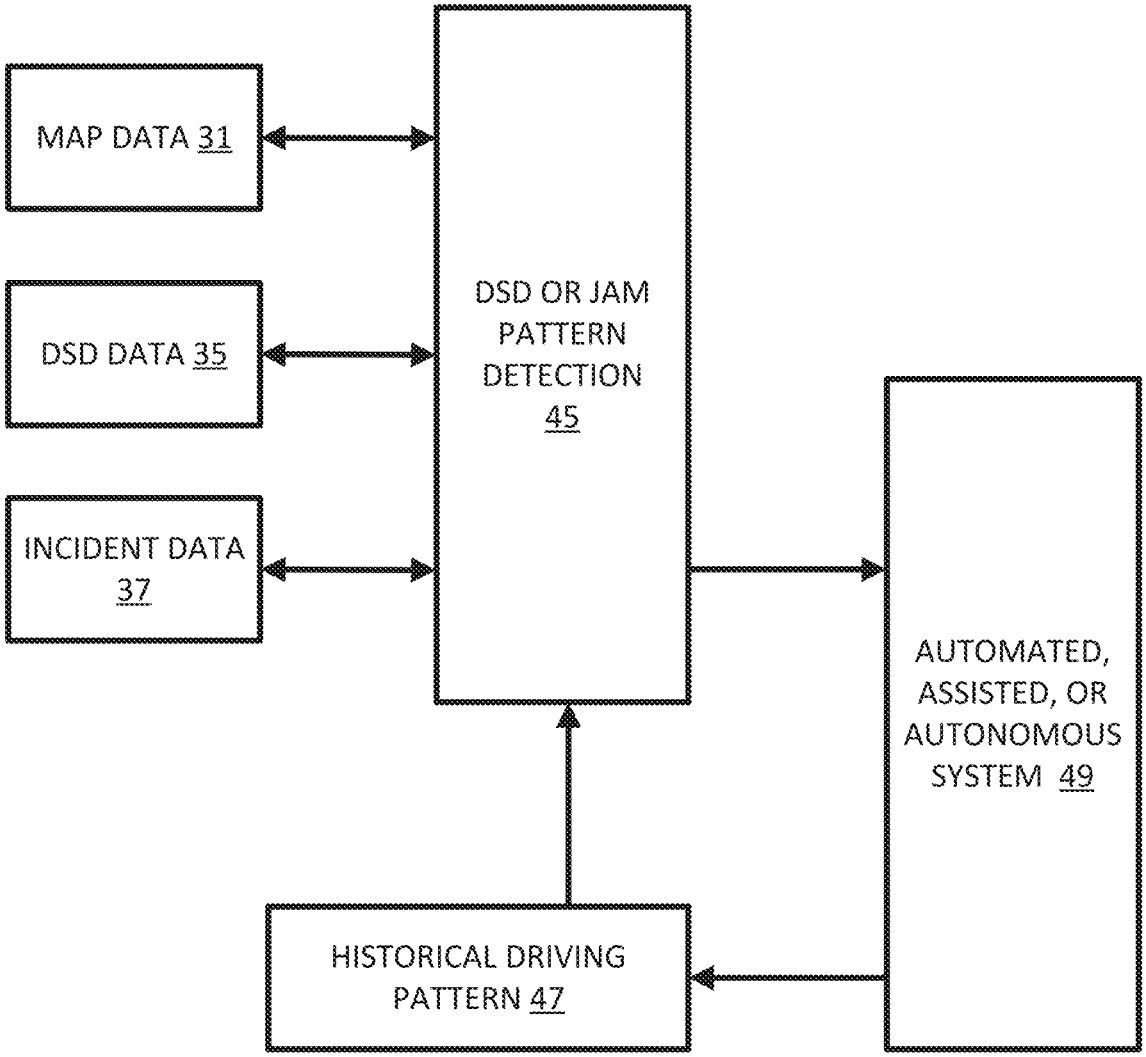
FIG. 5 illustrates an example system for the control of vehicles based on the slowdown events.

FIG. 5 illustrates an example system for the control of vehicles based on the slowdown events and/or the score for the road segment. The map data 31, DSD data 35, and/or incident data 36 is provided to the DSD or jam pattern protection 45, which calculates the slowdown events and/or the score for the road segment. As the result, the special safety warning messages is generated in backend DSD jam pattern system 45 to be delivered to the vehicle to warn the end driving user of entering the dangerous area (can be single or multiple TMCs) with high frequency DSD accidents reported and the proper recommend driving strategy. The event or score is provided to the automated, assisted, or autonomous system 49, which may also collect data to return a historical driving pattern 47 to the DSD or jam pattern protection 45. Additional, different, or fewer components may be included.

The DSD or jam pattern protection 45, or the system 49 in response to data received from the DSD or jam pattern protection 45, may provide a warning message to a vehicle according to the score. The warning message may be broadcast from the DSD processing engine 121 to mobile devices 122 or vehicles 124. The broadcast may be a radio broadcast. A radio transmission may be generated that includes the location of the slowdown event along with confidence value and/or severity factor through data messages over the air radio interface. Other examples for the communication include TPEG service by connected HTTP or UDP protocol, and/or DSRC broadcasting data.

Alternatively, the broadcast may be individual transmission sent to devices within a geofence or traveling along the same road segment or associated road segment. For example, the DSD processing engine 121 may identify other vehicles from the probe data 33 that are approaching the vent and send warning messages to the vehicles. The DSD processing engine 121 may also instruct vehicles to change their operation or reroute in response to the slowdown event, which is described in more detail below.

The DSD processing engine 121 may send messages to different devices according to the at least one setting for the vehicles. For example, the warning message may be distributed to a first set of recipients or vehicles that have opted for or been selected for a first tier of warning messages when the score is above a first threshold, and the warning message may be distributed to a second set of recipients or vehicles that have opted for or been selected for a second tier of warning messages when the score is above a second threshold.

The slowdown message may be distributed differently in different geographic regions. For example, in some areas such as Europe, slowdown events may be less dangerous because drivers tend to follow the "keep right except to pass" rule more diligently. Thus, in this geographic area, the slowdown messages may be sent out less liberally. Thus, the threshold for the at least one characteristic may be lower in Europe, than in North America, for example.

The warning message may include dispatch a vehicle to location of the slowdown event including emergency vehicles or a moving roadblock that slows traffic that is approaching the event.

The DSD or jam pattern protection 45, or the system 49 in response to data received from the DSD or jam pattern protection 45, may provide a navigation command in response to the score, which are discussed in more detail below. The DSD or jam pattern protection 45, or the system 49 in response to data received from the DSD or jam pattern protection 45, may provide a driving command in response to the score, which are discussed in more detail below.

The DSD processing engine 121 may generate different types of messages according to the score. For example, the message may reroute traffic when the score level is above a threshold and simply warn drivers when the confidence level is below the threshold. Similarly, the message may be avoid the road when the severity level is above a threshold and illuminate a flashing light when the severity level is below the threshold.

The knowledge of the current and future state of the autonomous vehicle has many benefits. When the autonomous vehicle (or systems within the vehicle) are additionally made aware of the reason for the traffic status update and not just the updated information, the autonomous vehicle has an enhanced understanding of the environment and can gain insight in to how best to react. Additionally, in-vehicle systems may make use of the DSD jam pattern information associated to a specific road segment to determine if the autonomous driving strategy with the better opportunity to avoid the hit Jam or even better to avoid the initiation of vehicle crash which may causes second time significant crash or vehicle pileup.

In general, the traffic service providers report real time static incidents on a specific road segment and warning messages to drivers driving upstream ahead of incidents. In some cases, the road segment of special topology geometry on the map like (bridge, tunnel, over the hill bend) will also be reported to remind the drivers of such types of road conditions. However, this is not sufficient to fully eliminate the risks of avoiding the accidents as many accidents were occurred due to different factors. The statistical study determines the correlation between the accidents and dangerous slow down events and a specific road segment or its environment.

Figure 6:
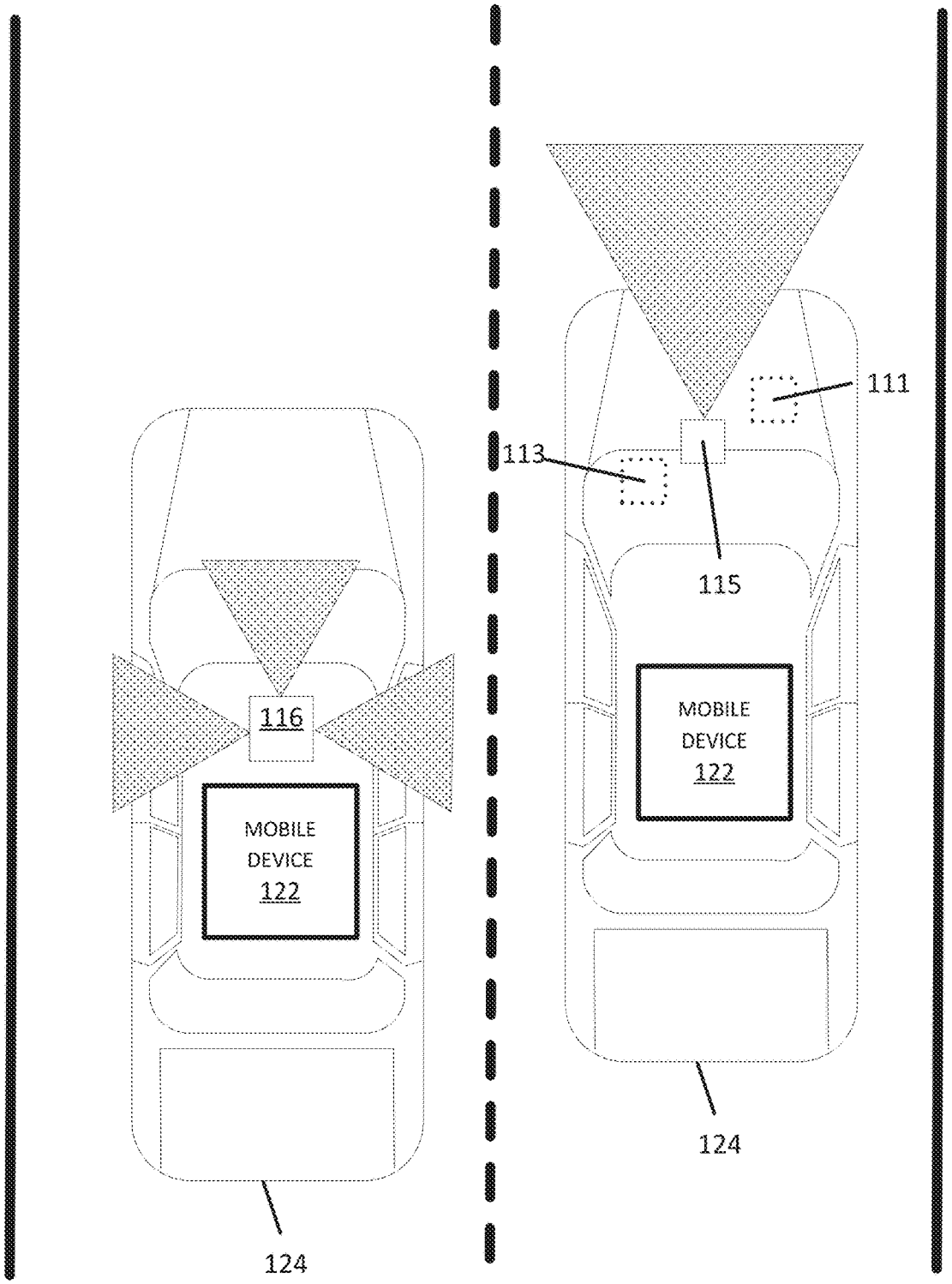
FIG. 6 illustrates an exemplary vehicle of the systems.

FIG. 6 illustrates an exemplary vehicle 124. One of the vehicles 124 may be a collection vehicle configured to collect data in the area proximate to the vehicle 124. The collection vehicle may include one or more distance data collection device or sensor, such as a light detection and ranging (LiDAR) device. The distance data collection sensor may generate point cloud data. The distance data collection sensor may include a laser range finder that rotates a mirror directing a laser to the surroundings or vicinity of the collection vehicle on a roadway or another collection device on any type of pathway. Other types of pathways may be substituted for the roadway in any embodiment described herein.

A connected vehicle includes a communication device and an environment sensor array for reporting the surroundings of the vehicle 124 to the server 125. The connected vehicle may include an integrated communication device coupled with an in-dash navigation system. The connected vehicle may include an ad-hoc communication device such as a mobile device 122 or smartphone in communication with a vehicle system. The communication device connects the vehicle to a network including at least one other vehicle and at least one server. The network may be the Internet or connected to the internet.

The sensor array may include one or more sensors configured to detect surroundings of the vehicle 124. The sensor array may include multiple sensors. Example sensors include an optical distance system such as LiDAR 116, an image capture system 115 such as a camera, a sound distance system such as sound navigation and ranging (SONAR), a radio distancing system such as radio detection and ranging (RADAR) or another sensor. The camera may be a visible spectrum camera, an infrared camera, an ultraviolet camera or another camera.

The vehicles 124 may include a global positioning system, a dead reckoning-type system, cellular location system, or combinations of these or other systems, which may be referred to as position circuitry or a position detector. The positioning circuitry may include suitable sensing devices that measure the traveling distance, speed, direction, and so on, of the vehicle 124. The positioning system may also include a receiver and correlation chip to obtain a GPS signal. Alternatively or additionally, the one or more detectors or sensors may include an accelerometer built or embedded into or within the interior of the vehicle 124.

In some alternatives, additional sensors may be included in the vehicle 124. An engine sensor 111 may include a throttle sensor that measures a position of a throttle of the engine or a position of an accelerator pedal, a brake senor that measures a position of a braking mechanism or a brake pedal, or a speed sensor that measures a speed of the engine or a speed of the vehicle wheels. Another additional example, vehicle sensor 113, may include a steering wheel angle sensor, a speedometer sensor, or a tachometer sensor.

The slowdown event detection algorithm is not limited to mobile or vehicle probe data or sensor data, other kind of in vehicle data like engine speed, brake sensor event, acceleration or deacceleration sensor, camera sensor could also be used as the assistance for slowdown event detection and message reporting.

A mobile device 122 may be integrated in the vehicle 124, which may include assisted driving vehicles such as autonomous vehicles, highly assisted driving (HAD), and advanced driving assistance systems (ADAS). Any of these assisted driving systems may be incorporated into mobile device 122. Alternatively, an assisted driving device may be included in the vehicle 124. The assisted driving device may include memory, a processor, and systems to communicate with the mobile device 122. The assisted driving vehicles may respond to geographic data received from geographic database 123 and the server 125 and driving commands or navigation commands received from the DSD processing engine 121 or generated locally at the vehicle.

The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes. The autonomous vehicle may steer, brake, or accelerate the vehicle based on the position of the vehicle in order, and may respond to geographic data received from geographic database 123 and the server 125 and driving commands or navigation commands received from the DSD processing engine 121 or generated locally at the vehicle.

A highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible. The HAD vehicle may control the vehicle through steering or braking in response to the on the position of the vehicle, and may respond to geographic data received from geographic database 123 and the server 125 and driving commands or navigation commands received from the DSD processing engine 121 or generated locally at the vehicle.

Similarly, ADAS vehicles include one or more partially automated systems in which the vehicle alerts the driver. The features are designed to avoid collisions automatically. Features may include adaptive cruise control, automate braking, or steering adjustments to keep the driver in the correct lane. ADAS vehicles may issue warnings for the driver based on the position of the vehicle or based on to geographic data received from geographic database 123 and the server 125 and driving commands or navigation commands received from the DSD processing engine 121 or generated locally at the vehicle.

It is worth to note the disclosed embodiments may be applied to any of these HAD or autonomous driving as the safety assistance dynamic content with or without lane level knowledge acknowledged depending on what ADAS applications to be targeted. An autonomous vehicle uses different sensors technologies and HD MAP or dynamic backend content including traffic information services to aid the in vehicles ECM system for the right decision strategy as how to drive along the road network.

Figure 7:
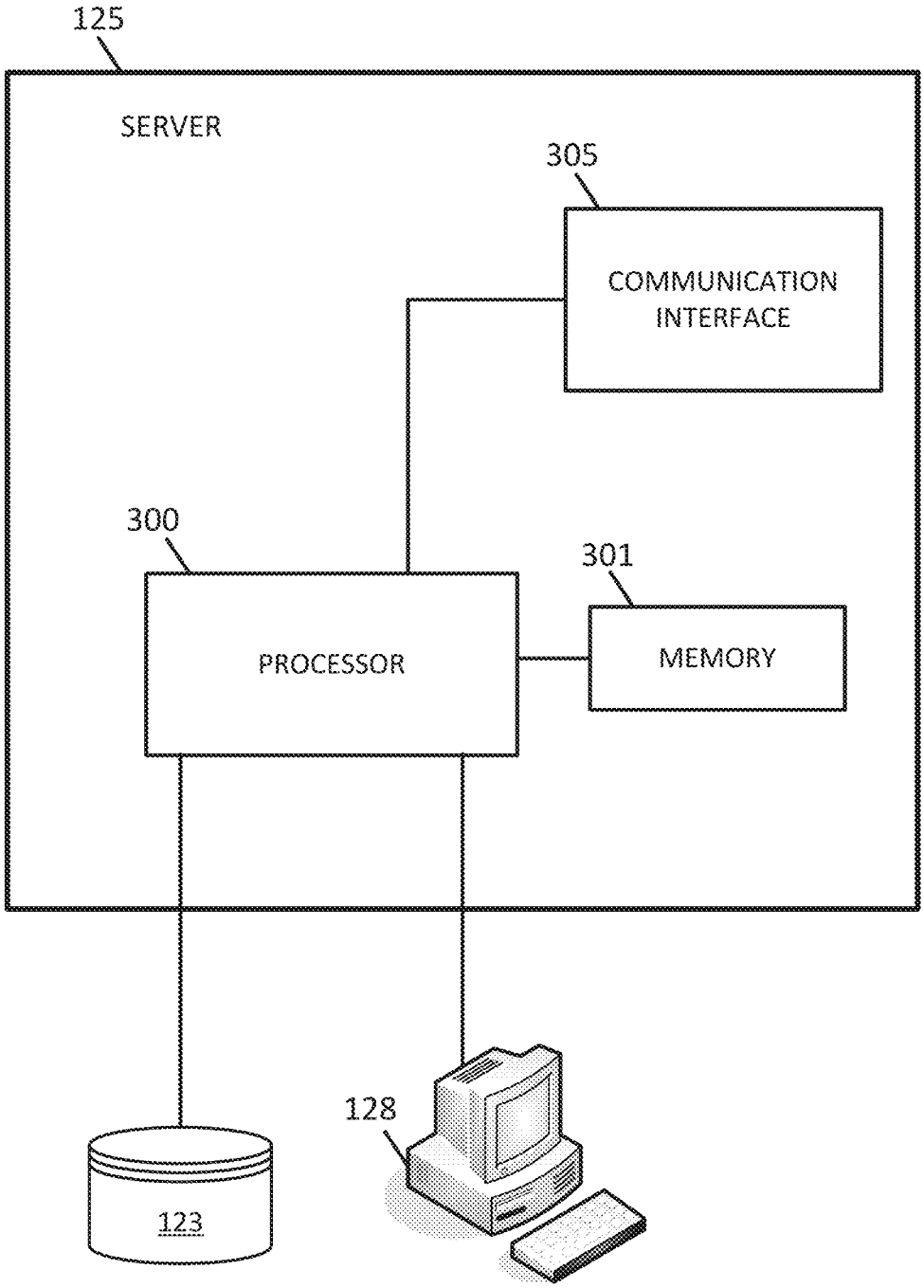
FIG. 7 illustrates an example server.

FIG. 7 illustrates an example server 125, which may apply to the system of FIG. 1. The server 125 includes a processor 300, a communication interface 305, a memory 301, and a database 123. An input device (e.g., keyboard or personal computer 128) may be used to enter settings to the server 125. Additional, different, or fewer components may be provided in the server 125.

Figure 8:
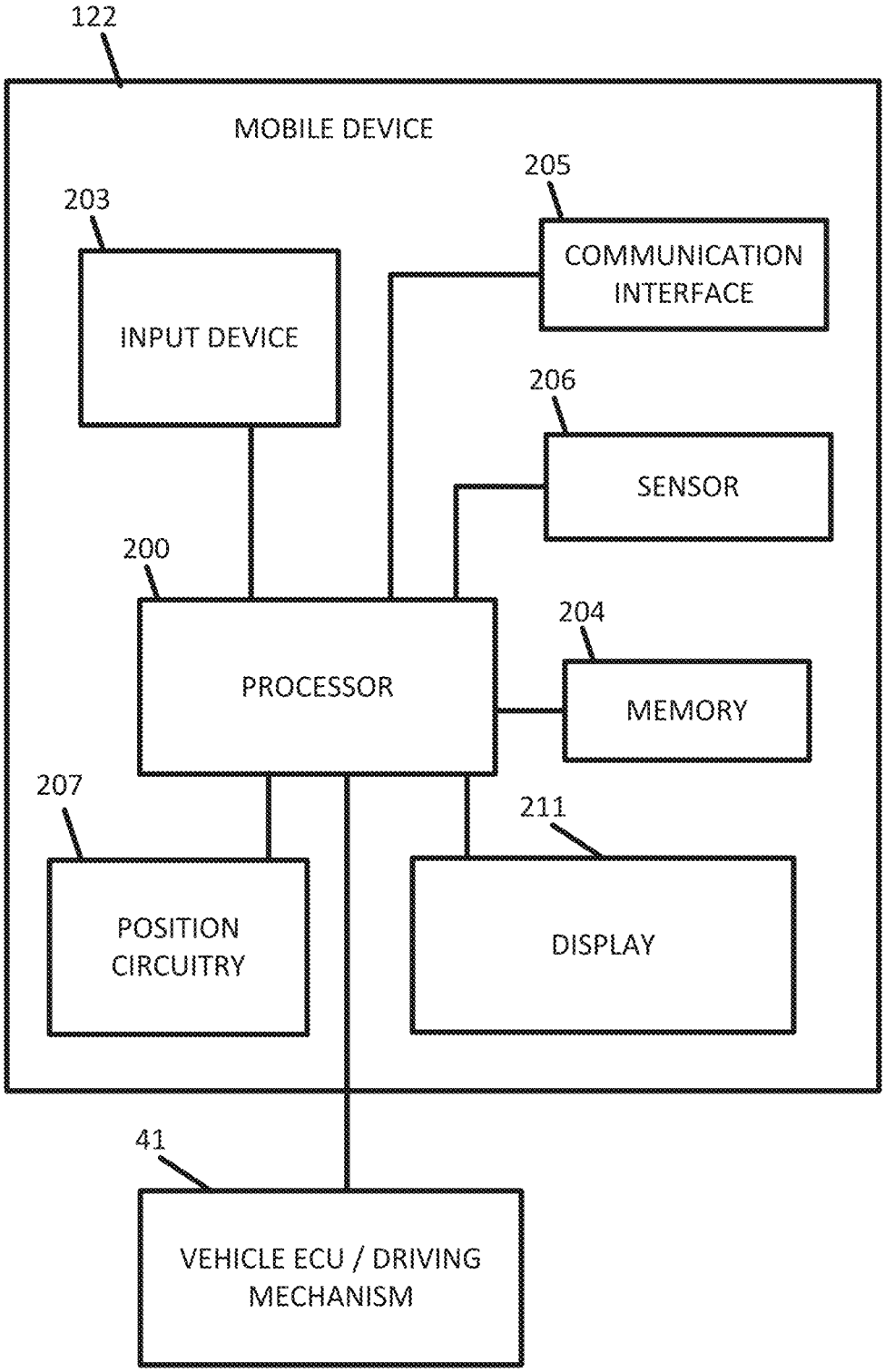
FIG. 8 illustrates an example mobile device.

FIG. 8 illustrates an exemplary mobile device 122 of the system of FIG. 1. The mobile device 122 includes a processor 200, a memory 204, an input device 203, a communication interface 205, position circuitry 207, a distance detector 209, a display 211, and a sensor 206. The input device 203 may receive commands from the user for default settings. The processor 200 may communicate with a vehicle ECU which operates one or more driving mechanisms 41 (e.g., accelerator, brakes, steering device). Alternatively, the mobile device 122 may be the vehicle ECU, which operates the one or more driving mechanisms directly. The sensor 206 may include a camera, a LiDAR device, or another sensor described herein. The sensor 206 may detect congestion local to the mobile device 122. The sensor 206 may detect when an intersection is approaching. Additional, different, or fewer components are possible for the mobile device 122.

Figure 9:
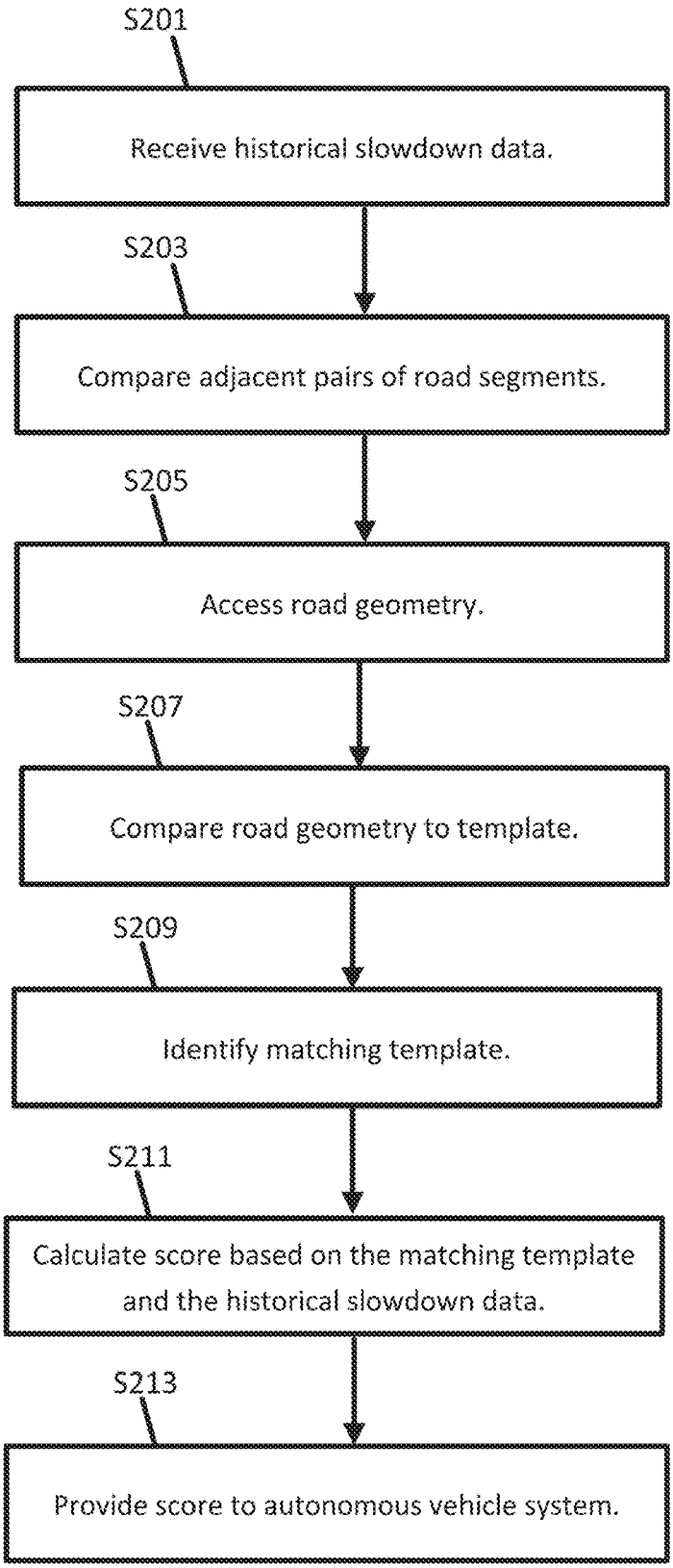
FIG. 9 illustrates an example flowchart for providing safety messages to one or more vehicles.

FIG. 9 illustrates an example flowchart for providing safety messages to one or more vehicles. The acts of FIG. 9 may be performed by the mobile device 122, the server 125, or a combination of the mobile device 122 and the server 125. Additional, different, or fewer acts may be included.

In act S201, historical data for a set of road segments is received. The historical data may be received from the sensor 206 and compiled over time. The historical data may be received at communication interface 205 or communication interface 305. The historical data may be received from the geographic database 123.

The set of road segments may be selected based on a request sent from the mobile device 122 to the server. The set of road segments may correspond to a route from an origin (e.g., current location) to a destination. The set of road segments may correspond to a geographic area, which may be selected according to the current location of the mobile device 122.

The historical data may include historical slowdown data and incident or accident data. The historical slowdown or DSD data may include at least one value associated with each road segment in the set of road segments. The incident or accident data may include records of accident, crash, or pileup events that have occurred on each road segment of the set of road segments in a geographical area.

The historical data may be derived from historical autonomous driving pattern information in the geographical area. Driving patterns are recorded by the autonomous vehicles are reported back to the server 125. Different aspects of the historical data may be correlated or associated with each other according to road segment. That is the historic autonomous driving pattern may be associated with the historical slowdown data.

In act S203, the processor 200 or the processor 300 compares data for adjacent pairs of road segments in the set of road segments. The comparison may be based on the historical data stored for the road segments or based on real time data collected for the road segments. Differences between the slowdown data for adjacent road segments are calculated. When the differences are above a threshold, the adjacent pair may be stored with an indication of a likelihood of incident. When the differences are above the threshold, the DSD event number may be archived in the jam pattern system.

The processor 200 or the processor 300 may include a comparison module including an application specific module or processor that compares the data for the adjacent road segments pairs. The comparison module is an example means for comparing historical data for adjacent pairs of road segments.

In act S205, accessing at least one road geometry for the set of road segments. The processor 200 or processor 300 may access the road geometry from memory 204 or memory 301, respectively. In act S207, the processor 200 or processor 300 performs a comparison of the at least one road geometry to a predetermined set of templates. The comparison may include a regression technique or image processing technique. The comparison may generate a value that indicate a degree of the match between the road geometry to the set of templates. In act S209, the processor 200 or processor 300 identifies a matching template in response to the comparison.

The processor 200 or the processor 300 may include a road geometry module including an application specific module or processor that compares the road geometries of the road segments to the templates. The road geometry module is an example means for accessing at least one road geometry for the set of road segments and means for performing a comparison of the at least one road geometry to a predetermined set of templates.

In act S211, the processor 200 or processor 300 calculates a score for the road segment based on the matching template and the historical slowdown data. Higher scores correspond to more risk or accident safety concern for vehicles traveling on the road segment, and lower scores correspond to less risk or accident safety concern for vehicles traveling on the road segment.

A starting value for the score may be based on the slowdown data collected for the road segment. The starting value may be adjusted based on the comparison of adjacent road segments in the historical data. The starting value may be adjusted by on the comparison with the templates for the road geometry.

The processor 200 or the processor 300 may include a scoring module including an application specific module or processor that calculates the score for the road segment. The scoring module is an example means for calculating the score for the road segment based on the matching template and the historical slowdown data.

In act S213, the score is provided to an autonomous driving system. A potential road segment variable limited speed or warning messages are determined by analyzing the score to mitigate the autonomous driving risk by providing the autonomous driving vehicle (e.g., ECM system) to make further driving strategy and decision. The notification of such autonomous driving safety message can be delivered to end customer through RDS messages over the air radio interface, TPEG service by connected HTTP or UDP protocol, or DSRC broadcasting data.

The score reflects any explanation for the slowdown event. For example, the comparison with road geometry at act S207 may indicate that a change in slowdown is expected in adjacent road segments because of the road geometry. When there is no explanation, the notification message at the could list "unknown reason" with warning message "reduce speed ahead" to autonomous vehicle drivers. Abnormal road segments will be further analyzed by their road geometry or other potential reasons. The term "abnormal" means one road segment has significant historical DSD event than its adjacent road segments upstream and downstream.

The warning message or recommend driving strategies based on the received score may be delivered when a driver is approaching a road segment or TMC where the road safety score exceeds the threshold (defined by the number of accidents in a period of time). That is, the processor 200 may receive current location data from position circuitry 207 and send a request based on the current location to the server 125 to receive the correspond score for the road segment. The returned score determines when information is provided to the driver, the autonomous driving instructions are modified, or a route is modified.

The processor 200 or the processor 300 may include a provision module including an application specific module or processor that provides the score to one or more autonomous vehicle. The provision module is an example means for providing the score to one or more autonomous vehicles based on location.

The processor 200 may include a routing module including an application specific module or processor that calculates routing between an origin and destination. The routing module is an example means for generating a routing command based on the slowdown message. The routing command may be a route from the route to the destination. The routing command may be a driving instruction (e.g., turn left, go straight), which may be presented to a driver or passenger, or sent to an assisted driving system. The display 211 is an example means for displaying the routing command. The mobile device 122 may generate a routing instruction based on the slowdown message. The routing instructions may be provided by display 211. The mobile device 122 may be configured to execute routing algorithms to determine an optimum route to travel along a road network from an origin location to a destination location in a geographic region. Using input(s) including map matching values from the server 125, a mobile device 122 examines potential routes between the origin location and the destination location to determine the optimum route. The mobile device 122, which may be referred to as a navigation device, may then provide the end user with information about the optimum route in the form of guidance that identifies the maneuvers required to be taken by the end user to travel from the origin to the destination location. Some mobile devices 122 show detailed maps on displays outlining the route, the types of maneuvers to be taken at various locations along the route, locations of certain types of features, and so on. Possible routes may be calculated based on a Dijkstra method, an A-star algorithm or search, and/or other route exploration or calculation algorithms that may be modified to take into consideration assigned cost values of the underlying road segments.

The mobile device 122 may plan a route through a road system, or modify a current route through a road system in response to the request for additional observations of the road object. For example, when the mobile device 122 determines that there are two or more alternatives for the optimum route and one of the routes passes the initial observation point, the mobile device 122 selects the alternative that passes the initial observation point. The mobile devices 122 may compare the optimal route to the closest route that passes the initial observation point. In response, the mobile device 122 may modify the optimal route to pass the initial observation point.

The mobile device 122 may be a personal navigation device ("PND"), a portable navigation device, a mobile phone, a personal digital assistant ("PDA"), a watch, a tablet computer, a notebook computer, and/or any other known or later developed mobile device or personal computer. The mobile device 122 may also be an automobile head unit, infotainment system, and/or any other known or later developed automotive navigation system. Non-limiting embodiments of navigation devices may also include relational database service devices, mobile phone devices, car navigation devices, and navigation devices used for air or water travel.

Figure 10:
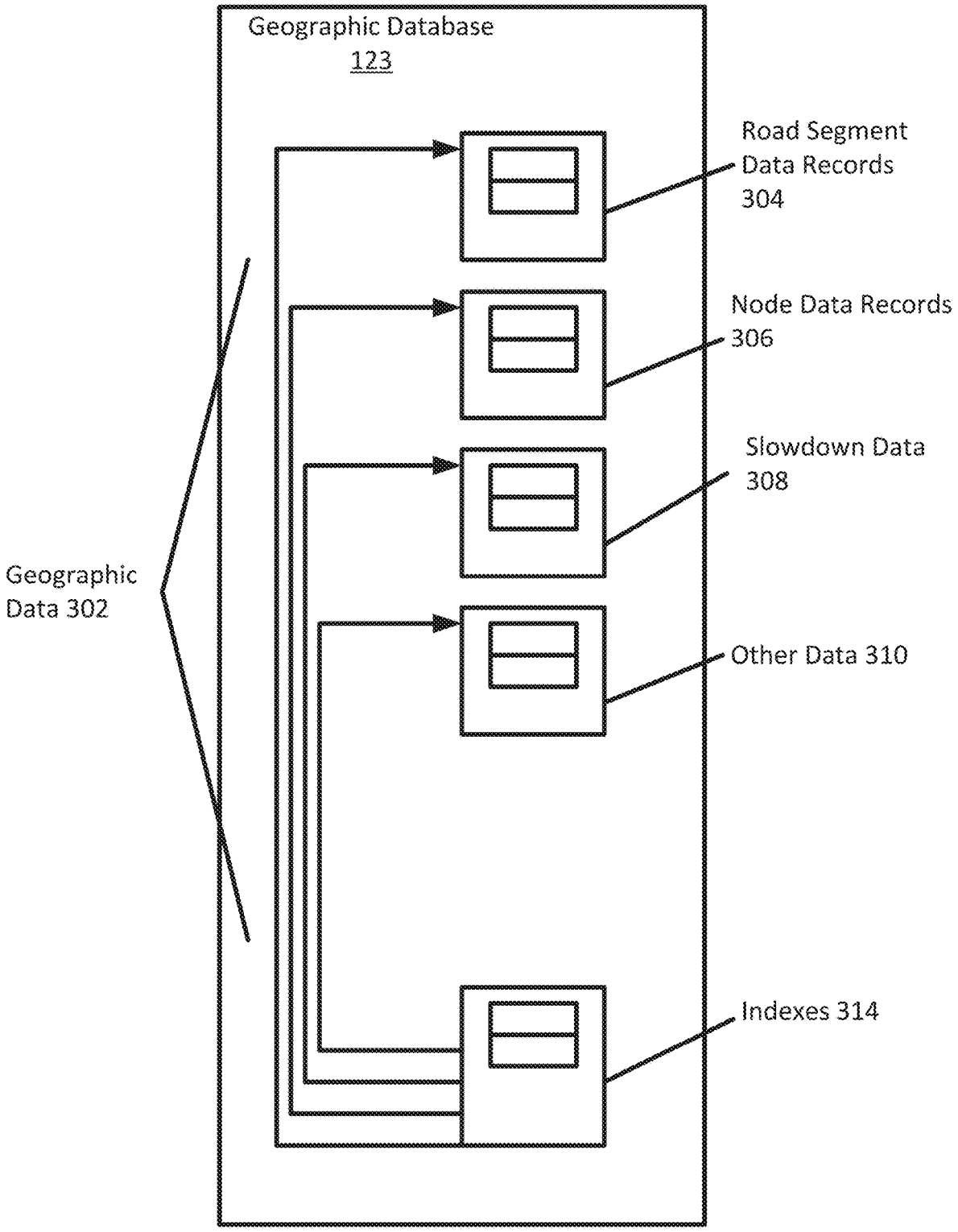
FIGS. 10 and 11 illustrate example geographic databases.

In FIG. 10 the geographic database 123 may contain at least one road segment database record 304 (also referred to as "entity" or "entry") for each road segment in a particular geographic region. The geographic database 123 may also include a node database record 306 (or "entity" or "entry") for each node in a particular geographic region. The terms "nodes" and "segments" represent only one terminology for describing these physical geographic features, and other terminology for describing these features is intended to be encompassed within the scope of these concepts. The geographic database 123 may also include location fingerprint data for specific locations in a particular geographic region.

The geographic database 123 may include other kinds of data 310. The other kinds of data 310 may represent other kinds of geographic features or anything else. The other kinds of data may include POI data. For example, the POI data may include POI records comprising a type (e.g., the type of POI, such as restaurant, hotel, city hall, police station, historical marker, ATM, golf course, etc.), location of the POI, a phone number, hours of operation, etc.

The geographic database 123 also includes indexes 314. The indexes 314 may include various types of indexes that relate the different types of data to each other or that relate to other aspects of the data contained in the geographic database 123. For example, the indexes 314 may relate the nodes in the node data records 306 with the end points of a road segment in the road segment data records 304.

As another example, the indexes 314 may include slowdown data 308. The slowdown data 308 may describe reported incidents of traffic slowing (e.g., DSD data). The slowdown data 308 may include the historic data described herein, which may be associated with a road segment in the segment data records 304 or a geographic coordinate. The historic data may include incident or accident data. The historical slowdown or DSD data may include at least one value associated with each road segment in the set of road segments. The incident or accident data may include records of accident, crash, or pileup events that have occurred on each road segment of the set of road segments in a geographical area. In the alternative or in addition, the historical data may be derived from historical autonomous driving pattern information in the geographical area.

The geographic database 123 may also include other attributes of or about roads such as, for example, geographic coordinates, physical geographic features (e.g., lakes, rivers, railroads, municipalities, etc.) street names, address ranges, speed limits, turn restrictions at intersections, and/or other navigation related attributes (e.g., one or more of the road segments is part of a highway or toll way, the location of stop signs and/or stoplights along the road segments), as well as POIs, such as gasoline stations, hotels, restaurants, museums, stadiums, offices, automobile dealerships, auto repair shops, buildings, stores, parks, municipal facilities, other businesses, etc. The geographic database 123 may also contain one or more node data record(s) 306 which may be associated with attributes (e.g., about the intersections) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data 302 may additionally or alternatively include other data records such as, for example, POI data records, topographical data records, cartographic data records, routing data, and maneuver data. Other contents of the database 123 may include temperature, altitude or elevation, lighting, sound or noise level, humidity, atmospheric pressure, wind speed, the presence of magnetic fields, electromagnetic interference, or radio- and micro-waves, cell tower and wi-fi information, such as available cell tower and wi-fi access points, and attributes pertaining to specific approaches to a specific location.

Figure 11:
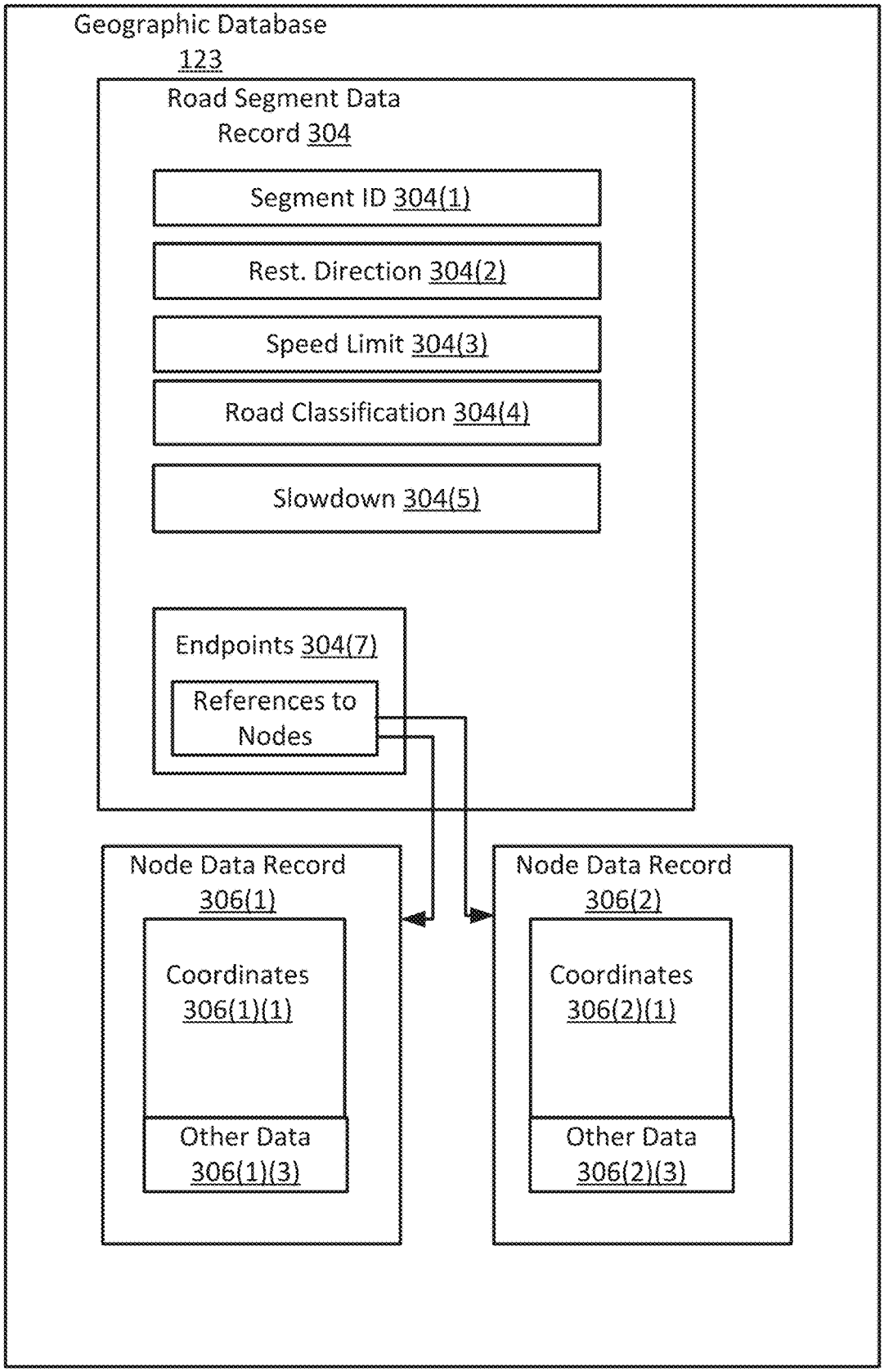

FIG. 11 shows some of the components of a road segment data record 304 contained in the geographic database 123 according to one embodiment. The road segment data record 304 may include a segment ID 304(1) by which the data record can be identified in the geographic database 123. Each road segment data record 304 may have associated with it information (such as "attributes", "fields", etc.) that describes features of the represented road segment. The road segment data record 304 may include data 304(2) that indicate the restrictions, if any, on the direction of vehicular travel permitted on the represented road segment. The road segment data record 304 may include data 304(3) that indicate a speed limit or speed category (i.e., the maximum permitted vehicular speed of travel) on the represented road segment. The road segment data record 304 may also include classification data 304(4) indicating whether the represented road segment is part of a controlled access road (such as an expressway), a ramp to a controlled access road, a bridge, a tunnel, a toll road, a ferry, and so on. The road segment data record may include location fingerprint data, for example a set of sensor data for a particular location.

The geographic database 123 may include road segment data records 304 (or data entities) including slowdown data 304(5) that describe historic slowdown data for the road segment.

Additional schema may be used to describe road objects. The attribute data may be stored in relation to a link/segment 304, a node 306, a strand of links, a location fingerprint, an area, or a region. The geographic database 123 may store information or settings for display preferences. The geographic database 123 may be coupled to a display. The display may be configured to display the roadway network and data entities using different colors or schemes.

The road segment data record 304 also includes data 304(7) providing the geographic coordinates (e.g., the latitude and longitude) of the end points of the represented road segment. In one embodiment, the data 304(7) are references to the node data records 306 that represent the nodes corresponding to the end points of the represented road segment.

The road segment data record 304 may also include or be associated with other data 304(7) that refer to various other attributes of the represented road segment. The various attributes associated with a road segment may be included in a single road segment record or may be included in more than one type of record which cross-references to each other. For example, the road segment data record 304 may include data identifying what turn restrictions exist at each of the nodes which correspond to intersections at the ends of the road portion represented by the road segment, the name, or names by which the represented road segment is identified, the street address ranges along the represented road segment, and so on.

FIG. 11 also shows some of the components of a node data record 306 that may be contained in the geographic database 123. Each of the node data records 306 may have associated information (such as "attributes", "fields", etc.) that allows identification of the road segment(s) that connect to it and/or its geographic position (e.g., its latitude and longitude coordinates). The node data records 306(1) and 306(2) include the latitude and longitude coordinates 306(1)(1) and 306(2)(1) for their node, the node data records 306(1) and 306(2) may also include other data 306(1)(3) and 306(2)(3) that refer to various other attributes of the nodes. In one example, the node data records 306(1) and 306(2) include the latitude and longitude coordinates 306(1)(1) and 306(2)(1) and the other data 306(1)(3) and 306(2)(3) reference slowdown data associated with the node. The slowdown data may include DSD data or autonomous pattern records associated with a node.

The geographic database 123 may be maintained by a content provider (e.g., a map developer). By way of example, the map developer may collect geographic data to generate and enhance the geographic database 123. The map developer may obtain data from sources, such as businesses, municipalities, or respective geographic authorities. In addition, the map developer may employ field personnel to travel throughout a geographic region to observe features and/or record information about the roadway. Remote sensing, such as aerial or satellite photography, may be used. The database 123 may be incorporated in or connected to the server 125.

The geographic database 123 and the data stored within the geographic database 123 may be licensed or delivered on-demand. Other navigational services or traffic server providers may access the location fingerprint data, traffic data and/or the lane line object data stored in the geographic database 123.

The processor 200 and/or processor 300 may include a general processor, digital signal processor, an application specific integrated circuit (ASIC), field programmable gate array (FPGA), analog circuit, digital circuit, combinations thereof, or other now known or later developed processor. The processor 200 and/or processor 300 may be a single device or combinations of devices, such as associated with a network, distributed processing, or cloud computing.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 801 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The input device 203 may be one or more buttons, keypad, keyboard, mouse, stylus pen, trackball, rocker switch, touch pad, voice recognition circuit, or other device or component for inputting data to the mobile device 122. The input device 203 and display 211 may be combined as a touch screen, which may be capacitive or resistive. The display 211 may be a liquid crystal display (LCD) panel, light emitting diode (LED) screen, thin film transistor screen, or another type of display. The output interface of the display 211 may also include audio capabilities, or speakers. In an embodiment, the input device 203 may involve a device having velocity detecting abilities.

The positioning circuitry 207 may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer and/or a magnetic sensor built or embedded into or within the interior of the mobile device 122. The accelerometer is operable to detect, recognize, or measure the rate of change of translational and/or rotational movement of the mobile device 122. The magnetic sensor, or a compass, is configured to generate data indicative of a heading of the mobile device 122. Data from the accelerometer and the magnetic sensor may indicate orientation of the mobile device 122. The mobile device 122 receives location data from the positioning system. The location data indicates the location of the mobile device 122.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. The mobile device 122 receives location data from the positioning system. The location data indicates the location of the mobile device 122.

The position circuitry 207 may also include gyroscopes, accelerometers, magnetometers, or any other device for tracking or determining movement of a mobile device. The gyroscope is operable to detect, recognize, or measure the current orientation, or changes in orientation, of a mobile device. Gyroscope orientation change detection may operate as a measure of yaw, pitch, or roll of the mobile device.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry. In an embodiment, a vehicle may be considered a mobile device, or the mobile device may be integrated into a vehicle.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. These examples may be collectively referred to as a non-transitory computer readable medium.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method for providing safety messages for vehicles, the method comprising:

receiving location data for at least a first vehicle of a plurality of vehicles;

map matching the location data for at least the first vehicle to a road segment;

identifying a road geometry for the matched road segment;

performing a comparison of a shape of the road geometry to a predetermined set of slowdown templates, each including a predetermined shape associated with a slowdown event;

identifying a matching slowdown template in response to the comparison;

receiving slowdown data for the road segment; and calculating a score for the road segment based on the matching slowdown template and the slowdown data.

2. The method of claim 1, further comprising:

calculating a score adjustment value for the matching slowdown template, wherein the calculated score includes the score adjustment value.

3. The method of claim 1, wherein the predetermined shapes of the predetermined set of slowdown templates include a predetermined turn, a predetermined slope, or a merge junction.

4. The method of claim 1, wherein the slowdown data is first slowdown data, the method further comprising:

identifying an adjacent road segment adjacent to the road segment; and receiving second slowdown data for the adjacent road segment.

5. The method of claim 4, wherein the adjacent road segment is an upstream road segment directly upstream of the road segment or a downstream road segment directly downstream of the road segment.

6. The method of claim 4, further comprising:

performing a comparison of the second slowdown data to an adjacent threshold; and storing the first slowdown data in association with the road segment in response to the comparison.

7. The method of claim 4, further comprising:

calculating a ratio between the first slowdown data to the second slowdown data.

8. The method of claim 1, further comprising:

performing a comparison of the slowdown data to a threshold; and storing the slowdown data in association with the road segment in response to the comparison.

9. The method of claim 8, wherein the road segment is a first road segment, further comprising:

selecting a second road segment in response to the comparison;

identifying a second road geometry for the second road segment;

receiving slowdown data for the second road segment; and calculating a score for the second road segment based on the second road geometry and the slowdown data.

10. The method of claim 1, wherein the slowdown data includes historical driving patterns from multiple vehicles.

11. The method of claim 1, further comprising:

providing a warning message to a vehicle according to the score.

12. The method of claim 1, further comprising:

generating a navigation command in response to the score or a driving command in response to the score.

13. The method of claim 1, wherein the slowdown data is associated with a time span or expiration.

14. An apparatus for providing safety messages for vehicles, the apparatus comprising:

a location module configured to access location data for at least a first vehicle of a plurality of vehicles;

a map matching module configured to match the location data for at least the first vehicle to a road segment;

a road geometry module configured to perform a comparison of a shape of a road geometry for the matched road segment to a predetermined set of slowdown templates, each including a predetermined shape associated with a slowdown event, and identify a matching slowdown template in response to the comparison; and a slowdown module configured to receive slowdown data for the road segment and calculate a score for the road segment based on the matching slowdown template and the slowdown data.

15. The apparatus of claim 14, wherein the slowdown module is configured to calculate a score adjustment value for the matching slowdown template, wherein the calculated score includes the score adjustment value.

16. The apparatus of claim 15, wherein the score adjustment value is determined based on a map matching technique.

17. The apparatus of claim 15, wherein the score adjustment value is determined based on a map matching confidence level.

18. The apparatus of claim 14, wherein the predetermined set of slowdown templates further includes a road feature.

19. The apparatus of claim 14, wherein a warning message, a navigation command, or a driving command is generated based on the score.

20. A non-transitory computer readable medium including instructions that when executed by a process are configured to perform:

receiving historical slowdown data for a set of road segments;

accessing at least one road geometry for the set of road segments;

performing a comparison of a shape of the at least one road geometry to a predetermined set of slowdown templates, each including a predetermined shape associated with a slowdown event;

identifying a matching slowdown template in response to the comparison; and calculating a score for the road segment based on the matching slowdown template and the historical slowdown data.

* * * * *